US006269232B1

(12) United States Patent
Fukumoto et al.

(10) Patent No.: US 6,269,232 B1
(45) Date of Patent: Jul. 31, 2001

(54) LIQUID JETTING APPARATUS AND ELECTROSTATIC LATENT IMAGE DEVELOPING APPARATUS

(75) Inventors: Hiroshi Fukumoto; Jyunichi Aizawa; Yasuhiko Ozaki, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/516,365

(22) Filed: Mar. 1, 2000

(30) Foreign Application Priority Data

Mar. 2, 1999 (JP) ..... 11-053533

(51) Int. Cl.[7] ..... G03G 15/10; B41J 2/14

(52) U.S. Cl. ..... 399/237; 347/47; 399/238

(58) Field of Search ..... 399/237, 238, 399/246; 239/102.1, 102.2; 347/10, 11, 46, 47, 94

(56) References Cited

U.S. PATENT DOCUMENTS 6,154,235 * 11/2000 Fukumoto et al. ..... 347/46
6,155,671 * 12/2000 Fukumoto et al. ..... 347/46
6,182,907 2/2001 Nakagawa et al. ..... 239/102.2

* cited by examiner

*Primary Examiner*—Sophia S. Chen
*Assistant Examiner*—Hoan Tran
(74) *Attorney, Agent, or Firm*—Leydig Voit & Mayer, Ltd.

(57) ABSTRACT

A longitudinal wave propagates in ink toward an opening. The surface of the ink is positioned at the opening and is curved. A surface wave is excited from an end of the liquid surface owing to a restoring force caused by surface tension of the ink. Assuming that the wavelength of the surface wave is λc, the diameter of the opening is established to be not smaller than 2m λc. The surface wave is generated from an edge of the opening and rapidly decreases due to the longitudinal wave. The surface waves caused by the longitudinal wave do not interfere with each other at the opening provided that certain conditions are established. Therefore, no complicated interference wave occurs on the surface of the ink, and the surface of the ink vibrates with a large amplitude in the vicinity of the edge of the opening.

15 Claims, 16 Drawing Sheets

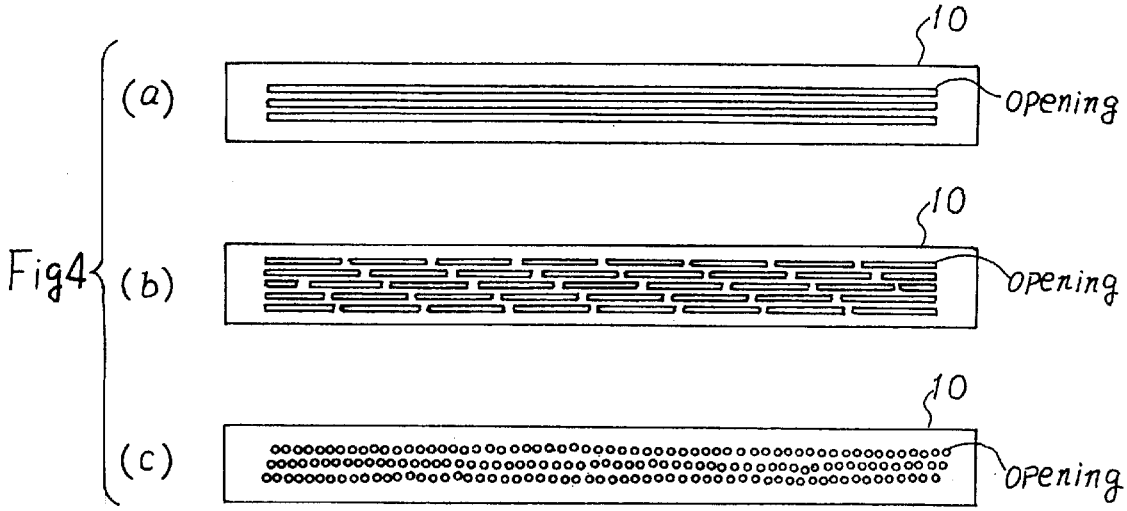
Fig.5
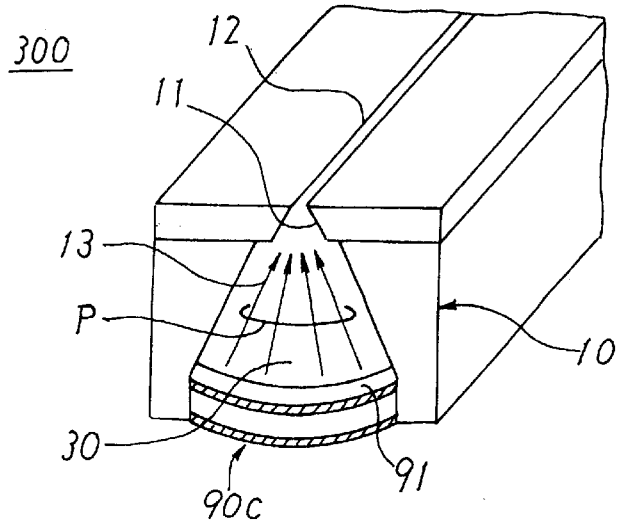

Fig.17
(a)
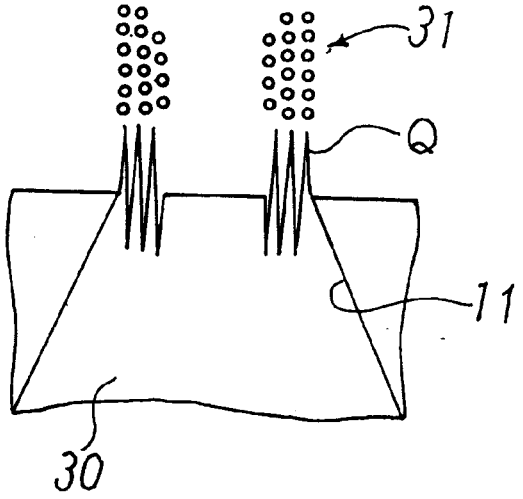
(b)
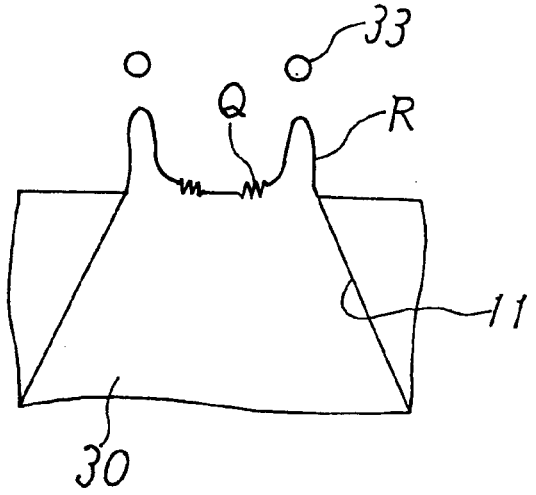

LIQUID JETTING APPARATUS AND ELECTROSTATIC LATENT IMAGE DEVELOPING APPARATUS

TECHNICAL FIELD

The present invention relates to an apparatus for jetting liquid and, more particularly, to a developing apparatus used when an electrostatic latent image is developed with liquid in a copying machine, an electrophotographic printer, or the like.

BACKGROUND ART

Hitherto, several attempts have been made to achieve a method for developing an electrostatic latent image by turning liquid ink into spray ink utilizing ultrasonic wave or static electricity and selectively applying it onto the electrostatic latent image with electrostatic power.

For example, in the art described in Japanese Patent Publication (examined) No. 52-7936 and Japanese Patent Publication (examined) No. 55-20230, a concave vibrator excites an ultrasonic wave in developing solution, and the developing solution is jetted from an opening portion of a container for storing the developing solution. Particularly, in the art described in Japanese Patent Publication No. 55-20230, the excitation by an ultrasonic wave is supplemental and an electric field from the electrostatic latent image causes a mist to generate from the developing solution. In the art described in Japanese Patent Publication (unexamined) No. 4-337772, a surface acoustic wave generated in a piezoelectric member forming a comb electrode jets a developing agent existing in the edge of the piezoelectric member.

Further, in the art described in Japanese Patent Publication (unexamined) No. 5-333703, standing-wave vibration of a transverse wave is excited in a member connected with a piezoelectric vibrator, thereby turning an ink supplied thereon into a mist, and the mist is charged by a grid electrode. Further, in the art described in Japanese Patent Publication (unexamined) No. 9-319229, a charged ink mist is sent to a developing position by a fan and is applied onto the electrostatic latent image.

However, in the Japanese Patent Publication (examined) No. 52-7936, the ultrasonic wave has a frequency of 20 to 30 kHz, and diameter or size of ink particles is large and their momentum is large. Therefore, developing solution is applied onto portions where any latent image does not exist (causing thereby so-called "scumming" and "fog"). As any particular jetting spout is not provided therein, it is impossible to efficiently decrease the particle size (particle diameter) by increasing the frequency of the ultrasonic wave. Furthermore, in the art described in Japanese Patent Publication No. 55-20230, it is impossible to increase generation amount of mist attracted with the power of the electric field of the electrostatic latent image, and it is difficult to attain a record of high speed and high density.

In the art described in Japanese Patent Publication (unexamined) No. 4-337772, manufacturing a mechanism for generating a surface acoustic wave requires a high processing accuracy, and the apparatus is not provided with any jetting spout. It is therefore suspected that the particle size of the developing solution varies widely.

In the art described in Japanese Patent Publication (unexamined) No. 5-333703, the apparatus becomes complicated and large in order to circulate ink with a pump and install the grid electrode. Further, since the apparatus uses a standing wave of a transverse wave, when particle size is decreased by shortening the wavelength, it is difficult to uniformly decrease them, eventually resulting in occurrence of scumming and. Moreover, depressed portions on the grid electrode are stained with ink, and periodical cleaning is necessary.

Particularly in Japanese Patent Publication (unexamined) No. 9-319229, the apparatus becomes complicated and large in order to convey ink mist with a fan and install a dielectric charged electrode. Moreover, it takes a lot of time from the generation of the ink mist until it is ready for developing because the ink mist is conveyed with the fan. It is very difficult to control density of the mist on the basis of the printing density and control start/stop for jetting the mist.

DISCLOSURE OF THE INVENTION

Accordingly, the invention was made to solve the above-discussed problems, and has an object of providing a liquid jetting apparatus of simple construction, in which maintenance is easy, and uniform liquid-drops can be generated at high speed and high density.

Another object of the invention is to provide an electrostatic latent image developing apparatus in which density is adjusted according to time lag from generation of liquid-drops to development and to printing density.

The foregoing objects and advantages are achieved by providing a new and improved liquid jetting apparatus including:

a container for storing liquid to be jetted and having a jetting spout for jetting said liquid to be jetted; and a sound wave generation source which is arranged opposite to the jetting spout on said container and introduces a sound wave, in which a set of n ($\geqq 2$) pulses of a predetermined cycle forms a lump and two such lumps adjacent to each other are divided by a period having no pulse of said predetermined cycle or longer, into the liquid to be jetted;

wherein said jetting spout has an opening width of not less than 2m (m is a maximum value of n with respect to all of said lumps of pulses) times of a wavelength of a surface traveling wave of the liquid to be jetted excited by said sound wave.

The present invention provides an electrostatic latent image developing apparatus including:

a container for storing liquid to be jetted and having a jetting spout for jetting said liquid to be jetted;

a sound wave generation source which is arranged opposite to the jetting spout on said container and introduces a sound wave, in which a set of n ($\geqq 2$) pulses of a predetermined cycle forms a lump and two such lumps adjacent to each other are divided by a period having no pulse of said predetermined cycle or longer, into the liquid to be jetted; and a latent image carrier where an electrostatic latent image is produced and moves;

wherein said jetting spout has an opening width of not less than 2m (m is a maximum value of n with respect to all of said lumps of pulses) times of a wavelength of a surface traveling wave of the liquid to be jetted excited by said sound wave, and develops said electrostatic latent image by selectively applying the liquid to be jetted onto the electrostatic latent image.

The present invention also provides an electrostatic latent image developing apparatus including:

a latent image carrier where an electrostatic latent image is produced and moves;

a container for storing liquid to be jetted and having a jetting spout for jetting said liquid to be jetted;

a sound wave generation source which is arranged opposite to the jetting spout on said container and introduces a sound wave, in which a set of n (≧2) pulses of a predetermined cycle forms a lump and two such lumps adjacent to each other are divided by a period having no pulse of said predetermined cycle or longer, into the liquid to be jetted; and a liquid jetting apparatus for developing said electrostatic latent image by selectively applying the liquid to be jetted onto the electrostatic latent image;

wherein density of the electrostatic latent image is detected from a picture signal on which the electrostatic latent image is based, and amount of said liquid jetted by said liquid jetting apparatus in a unit time is controlled on the basis of said density.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF DRAWINGS

FIGS. 4(*a*)–4(*c*) are plan views showing a variation of embodiment 2 of the invention.

FIG. 5 is a sectional perspective view showing a construction according to embodiment 3 of the invention.

FIGS. 17(*a*) and 17(*b*) are schematic views showing the background according to embodiment 6 of the invention.

BEST MODE FOR CARRYING OUT THE INVENTION

Embodiment 1

Figure 1:
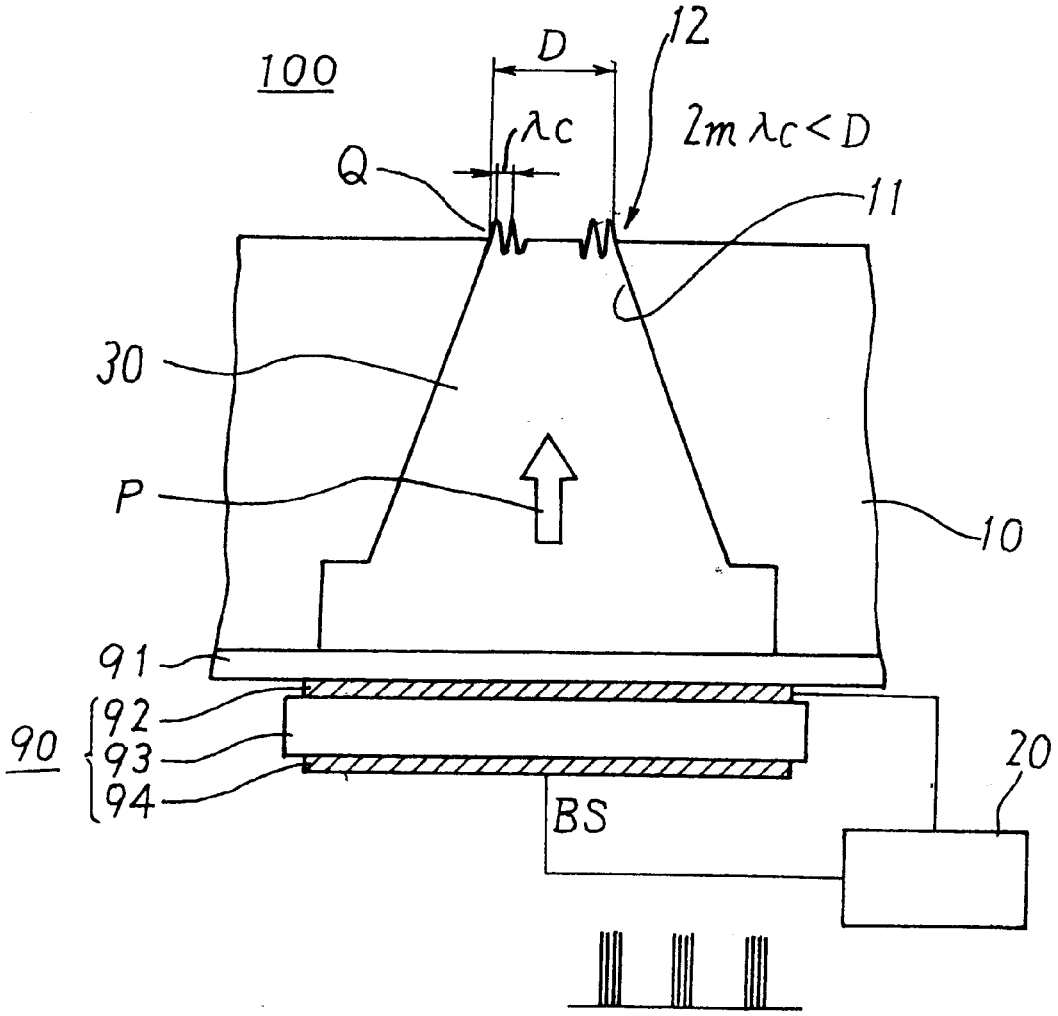
FIG. 1 is a sectional view showing a construction according to embodiment 1 of the invention.

FIG. 1 is a sectional view showing a construction of an ink jetting apparatus 100 according to embodiment 1 of the invention. An ink 30 is stored in an ink tank 10, and the liquid surface is exposed at an opening 12 which is opened at one main face (upper side in the drawing) of the ink tank 10. A piezoelectric transducer 90 is arranged on the other main face (the lower side in the drawing) of the ink tank 10 opposed to the opening 12, and gives a thickness longitudinal vibration to the ink 30 in order to propagate a longitudinal wave P from the other main face of the ink tank 10 to the one main face. In the drawing, the arrow, inside of which is blank, showing a longitudinal wave P is directed to the traveling direction.

In the vicinity of the opening 12, an inner face of the ink tank 10 has inclination to be narrower along the propagating direction of the longitudinal wave P to form a nozzle 11.

The piezoelectric transducer 90 is arranged on the ink tank 10 through an insulating plate 91, in which a first electrode 92, a piezoelectric vibrator 93, and a second electrode 94 are piled up in this order from the ink tank 10 side. A drive 20 is connected between the first electrode 92 and the second electrode 94 from outside of the ink jetting apparatus 100. The drive 20 generates burst signals BS and causes the piezoelectric vibrator 93 to generate thickness longitudinal vibration. The insulating plate 91 has a function to hold the ink 30 with the ink tank 10 and a function to insulate the ink tank 10 from the burst signals BS together. The burst signals BS used herein indicate signals in which a set of n (≧2) pulses of a predetermined cycle Ta forms a lump (group) and two such lumps adjacent to each other are divided by a period having no pulse of said predetermined cycle Ta or longer. For example, this lump is repeatedly generated in a burst period Tb (>m·Ta: m is a maximum value of n of all of said lumps of pulses). The reciprocal of the period Ta in one lump is assumed to be a fundamental frequency fa, and the reciprocal of the burst period Tb is assumed to be a burst frequency fb.

Following the burst signals BS, the longitudinal wave P, in which two lumps adjacent to each other are divided by a period having no pulse of said predetermined cycle Ta or longer, is generated.

Consideration is now given to a surface wave Q generated on the liquid surface of the ink 30 exposed at the opening 12.

The longitudinal wave P propagates in the ink 30 toward the opening 12. The liquid surface of the ink 30 is positioned at the opening 12, and therefore the end portion of the liquid surface is curved. And a surface wave Q is excited from the end portion of the liquid surface owing to a restoring force caused by surface tension of the ink. It is publicly known that establishing surface tension of the ink 30 as $\sigma$, density as $\rho$ and wavelength of the surface wave Q as $\lambda$ c, the propagation velocity Vc is expressed by $Vc=(2\pi\sigma/\rho/\lambda\ c)^{1/2}$. Since $\lambda$ c=Vc/fa, an expression of $\lambda\ c=(2\pi\sigma/\rho/fa^2)^{1/3}$ is obtained.

FIG. 1 is a sectional view, and configuration of the opening 12 is defined to neither a circle nor a rectangle. In this embodiment, the configuration of the opening 12 can be a circle, a rectangle, or any other configuration. However, the opening diameter D is essentially established to be not smaller than 2m $\lambda$c. The surface wave Q is generated from the edge of the opening 12 and rapidly decreases due to stop of the longitudinal wave P. Accordingly, the surface waves Q caused by the longitudinal wave P do not interfere with each other at the opening 12 provided that such conditions are established. Therefore, any complicated interference wave does not occur on the liquid surface of the ink 30, and the liquid surface of the ink 30 vibrates with a large amplitude in the vicinity of the edge of the opening 12.

Figure 2:
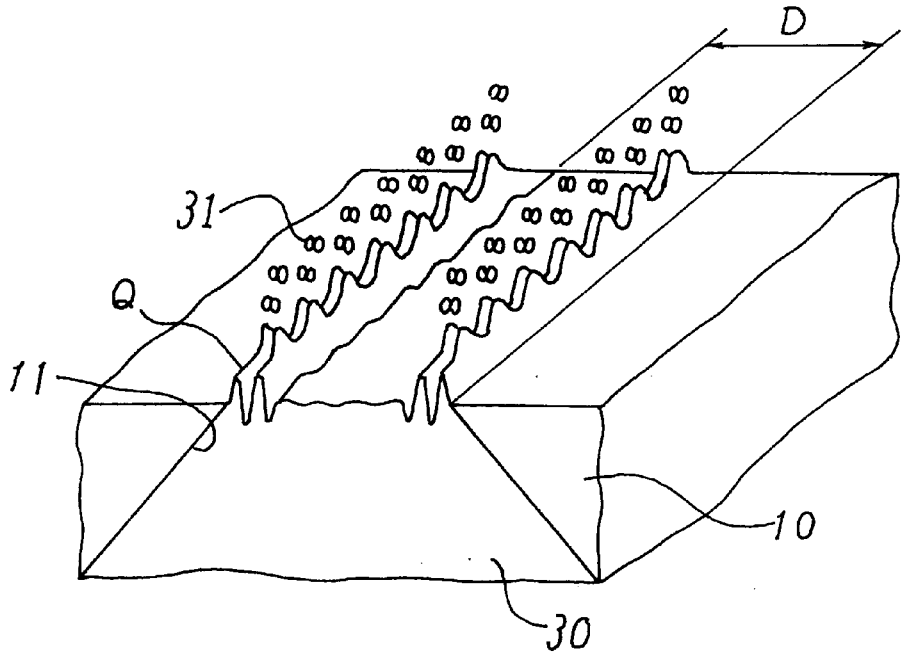
FIG. 2 is a sectional perspective view showing the construction according to embodiment 1 of the invention.

FIG. 2 is a sectional perspective view partially showing a construction near the opening 12, and it is herein shown that the opening 12 possesses two sides which are in parallel to each other with a distance of the diameter D. Liquid-drops 31 of the ink 30 are jetted from the edge of the opening 12 by appropriately increasing the amplitude of the burst signals BS. The liquid-drops 31 are jetted from the liquid surface due to such a surface wave Q, and the diameter D depends almost exclusively on Ac. For example, when fa=10 MHz, the surface tension of the ink 30 is $\sigma=50\times10^{-3}$ N/m, and the density is $\rho=1.0\times10^3$ kg/m$^3$, the wave length $\lambda$ c of the surface wave Q becomes about 1.5 $\mu$m, andthe average particle size (particle diameter) is 2 $\mu$m.

In the ink jetting apparatus 100 according to this embodiment, by generating the surface waves Q, which do not interfere with each other and therefore the waveform is not bent, on the liquid surface at the opening 12 due to the longitudinal wave P of the fundamental frequency fa propagating in the ink 30, it is possible to jet the liquid-drops 31 of small particle size which does not vary widely. As a result, it is possible to restrain scumming and fog. It is also possible to control the burst signals BS and jet a large amount of ink.

Furthermore, response characteristic for jetting the ink 30 is superior, and when the apparatus is adopted in the electrostatic latent image developing apparatus described later, density control and on/off control are also superior. The apparatus has a simple construction, and the apparatus of small size can be manufactured.

As a matter of course, the wave that propagates in the ink 30 is not limited to the longitudinal wave P, but can be any transverse wave as far as it excites the surface wave Q from the edge of the opening 12. The construction for exciting the longitudinal wave P is not limited to the piezoelectric transducer 90, and it is possible to use a magneto-strictive transducer, instead.

Embodiment 2

Figure 3:
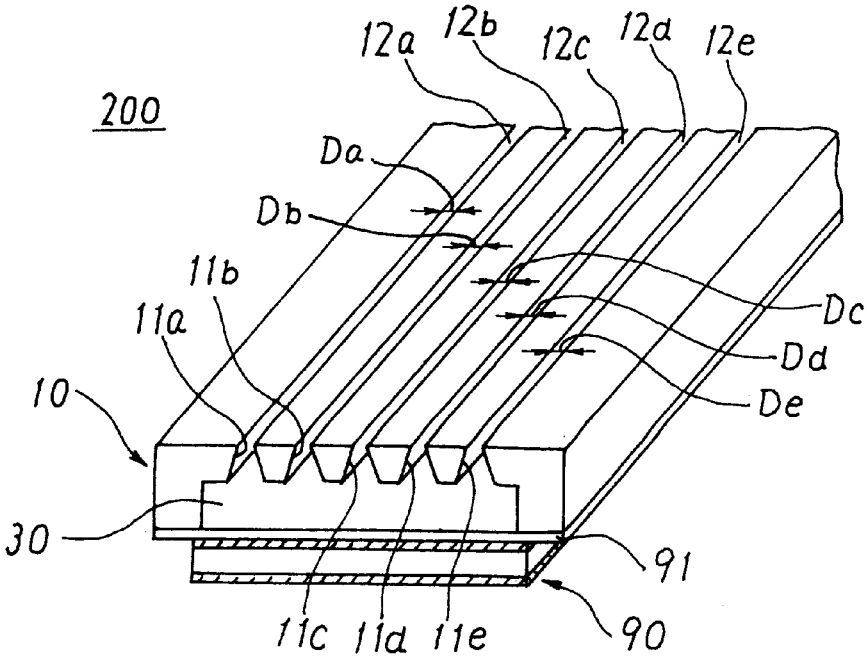
FIG. 3 is a sectional perspective view showing a construction according to embodiment 2 of the invention.

FIG. 3 is a sectional perspective view showing a construction of an ink jetting apparatus 200 according to preferred embodiment 2 of the invention. The ink 30 is stored in the ink tank 10, and the ink tank 10 is provided with a piezoelectric transducer 90 holding an insulating plate 91 between them. The drive 20 is omitted herein.

As compared with the foregoing ink jetting apparatus 100, the ink jetting apparatus 200 is provided with line-shaped lanes, and the ink tank 10 is provided with openings 12*a*, 12*b*, 12*c*, 12*d*, and 12*e* arranged in parallel to each other, which is a difference in the aspect of feature. In the same manner as the relation between the opening 12 and the nozzle 11 in the ink jetting apparatus 100, inner face of the ink tank 10 has inclination corresponding to the openings 12*a*, 12*b*, 12*c*, 12*d*, and 12*e*, and forms nozzles 11*a*, 11*b*, 11*c*, 11*d*, and 11*e* respectively. The openings 12*a*, 12*b*, 12*c*, 12*d*, and 12*e* have widths Da, Db, Dc, Dd, and De, respectively, and each of them is established to be not smaller than the foregoing 2m $\lambda$c.

As shown in the foregoing embodiment 1, the surface wave Q is excited at the edge of the opening 12 and is rapidly attenuated due to stop of the longitudinal wave P, and the liquid-drops 31 are generated in the vicinity of the edge of the opening 12. Therefore, when size of the piezoelectric transducer is the same, i.e. the range where the longitudinal wave P propagates is the same, the edge increases in number as the opening increases in number in the range, and a larger amount of ink 30 can be jetted, which facilitates a high-speed and high-density development.

Particularly, when the ink is supplied from the ink jetting apparatus to an electrostatic latent image formed on a rotary drum as described later, it is preferred to dispose the openings extensively in a direction parallel to the axis of rotation of the rotary drum.

FIGS. 4(*a*)–4(*c*) are plan views illustrating a variation of a pattern to increase number of the openings. As shown in FIG. 4(*a*), it is preferred to arrange simple line-shaped openings in parallel, or as shown in FIG. 4(*b*), it is also preferred to separately form the openings in longitudinal direction. Alternatively, as shown in FIG. 4(*c*), it is preferred to arrange circular openings forming at least two lines. In any of these cases, the opening width and the circle diameter are arranged to be not smaller than the foregoing 2m $\lambda$c as a matter of course.

Embodiment 3

It is possible to increase the amplitude of the surface wave Q generated on the liquid surface of the ink 30 by converging the longitudinal wave P near the nozzle 11, whereby a large amount of the liquid-drops 31 can be jetted. Particularly, when the ink is supplied from the ink jetting apparatus to the electrostatic latent image formed on the rotary drum as described later, it is preferred to extend the nozzle 11 in a direction parallel to the axis of rotation of the rotary drum. In that case, it is preferred to also extend the convergence position of the longitudinal wave P forming a line along the nozzle 11.

FIG. 5 is a sectional perspective view showing a construction of an ink jetting apparatus 300 according to embodiment 3 of the invention. The ink 30 is stored in the ink tank 10, and the ink tank 10 is provided with the piezoelectric transducer 90 through the insulating plate 91. The drive 20 is omitted herein.

The piezoelectric transducer 90*c* has a concave facing to the opening 12, and the longitudinal wave P generated therefrom converges at a focus 13. The nozzle 11 is arranged near there, and after the convergence, the longitudinal wave P travels almost perpendicularly toward the opening 12. Therefore, the same advantage as in the foregoing embodiment 1 is achieved while increasing the amplitude of the surface wave Q. In other words, it is possible to decrease the amplitude of the burst signals BS required for jetting the same amount of ink, resulting in the simple and small drive 20. A piezoelectric transducer 90*c* with such a concave is publicly known, and is disclosed in the foregoing Japanese Patent Publication No. 52-7936, for example.

Figure 6:
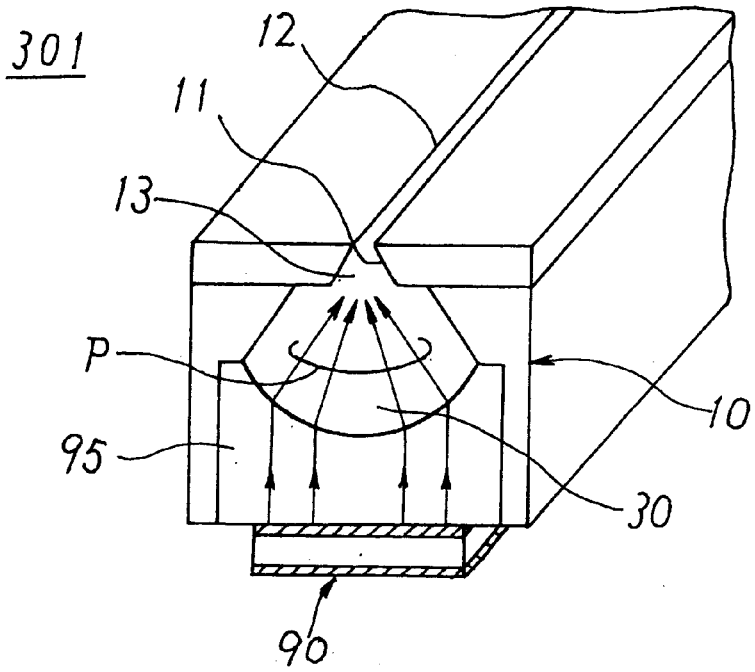
FIG. 6 is a sectional perspective view showing another construction according to embodiment 3 of the invention.

FIG. 6 is a sectional perspective view showing a construction of another ink jetting apparatus 301 according to this embodiment 3 of the invention. In the same manner as the foregoing embodiment 1, the piezoelectric transducer 90 in the shape of a flat plate is used instead of the piezoelectric transducer 90*c*, but an acoustic lens 95 is provided instead of the insulating plate 91. The acoustic lens 95 has a concave facing to the opening 12, and a flat face thereof contacts the flat plate-shaped piezoelectric transducer 90.

The longitudinal wave P generated from the piezoelectric transducer 90 is refracted by the acoustic lens 95 and converges at the focus 13. As the nozzle 11 is arranged near there, the same advantage as in the ink jetting apparatus 300 is achieved also in the ink jetting apparatus 301. Such an acoustic lens 95 is also publicly known.

Figure 7:
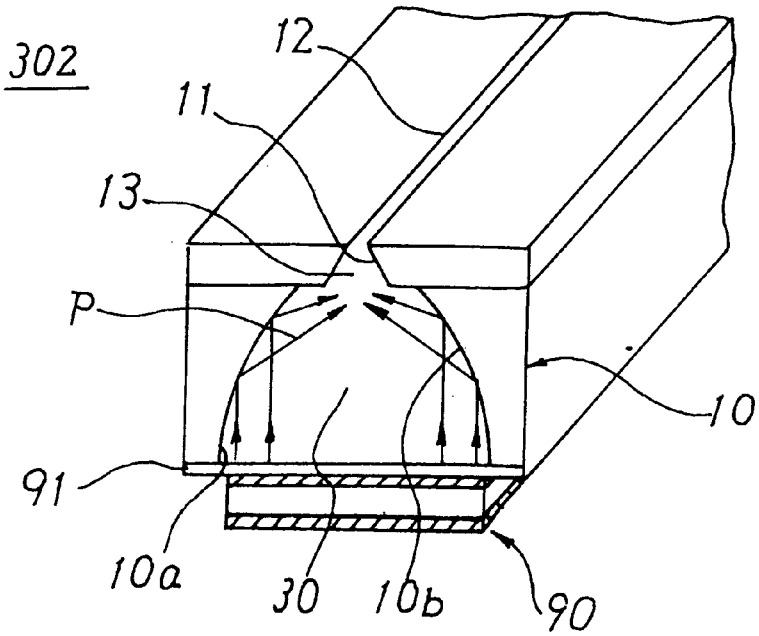
FIG. 7 is a sectional perspective view showing a further construction according to embodiment 3 of the invention.

FIG. 7 is a sectional perspective view showing a construction of a further ink jetting apparatus 302 according to this embodiment 3 of the invention. This modification is different from the ink jetting apparatus 100 shown in the foregoing embodiment 1 in the aspect that inner walls 10*a* and 10*b* forming parabolic faces having a common focus 13.

A sound wave P in the shape of a flat plate generated from the flat plate-shaped piezoelectric transducer 90 to the opening 12 is reflected by the inner walls 10*a* and 10*b* forming parabolic faces, and converges at the focus 13. As the nozzle 11 is arranged near there, the same advantage as in the ink jetting apparatus 300 is obtained likewise in the ink jetting apparatus 302. The inner wall 10*a* of such a configuration is also publicly known, and is disclosed in Japanese Patent Publication (unexamined) No. 10-278253, for example.

Embodiment 4

It is possible to combine the foregoing embodiment 2 and embodiment 3 and achieves both advantages of them.

Figure 8:
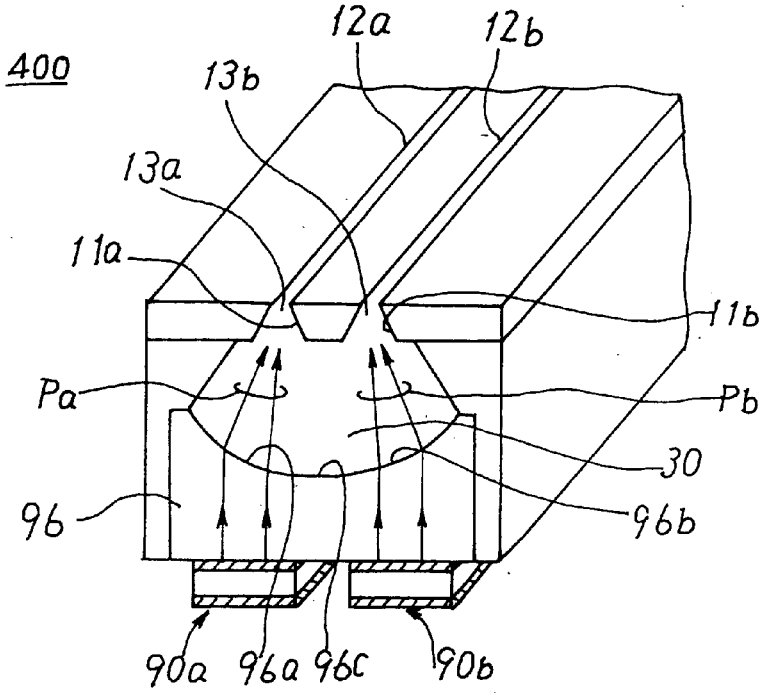
FIG. 8 is a sectional perspective view showing a construction according to embodiment 4 of the invention.

FIG. 8 is a sectional perspective view showing a construction of an ink jetting apparatus 400 according to embodiment 4 of the invention. In this embodiment, as compared with the ink jetting apparatus 301 shown in FIG. 6 in embodiment 3, the piezoelectric transducer 90 is replaced with a pair of flat plate-shaped piezoelectric transducers 90*a* and 90*b*, and the acoustic lens 95 is replaced with an acoustic lens 96. The combination of the nozzle 11 and the opening 12 is also replaced with two combinations of nozzles 11*a* and 11*b* and openings 12*a* and 12*b*.

The acoustic lens 96 has concaves 96*a* and 96*b* respectively facing to the openings 12*a* and 12*b*, and a flat face thereof contacts the flat plate-shaped piezoelectric transducer 90. However, the concaves 96*a* and 96*b* have focuses 13*a* and 13*b* in the vicinity of the nozzles 11*a* and 11*b* corresponding to the openings 12*a* and 12*b* respectively, and are away from each other by a distance equivalent to the that between the openings 12*a* and 12*b*, as compared with the foregoing ink jetting apparatus 301. Therefore, a flat plate 96*c* is disposed between the concaves 96*a* and 96*b* in the drawing. The concaves 96*a* and 96*b* refract longitudinal waves Pa and Pb generated from the piezoelectric transducers 90*a* and 90*b*, and cause them to converge into the focuses 13*a* and 13*b*, respectively.

In this embodiment, both advantages performed in embodiment 2 and embodiment 3 are achieved by increasing number of openings and converging longitudinal waves. Furthermore, since the acoustic lens 96 has the concaves 96*a* and 96*b* corresponding to the two different focuses 13*a* and 13*b*, a less space is required as compared with the construction wherein the ink jetting apparatus 301 are simply arranged in parallel.

Figure 9:
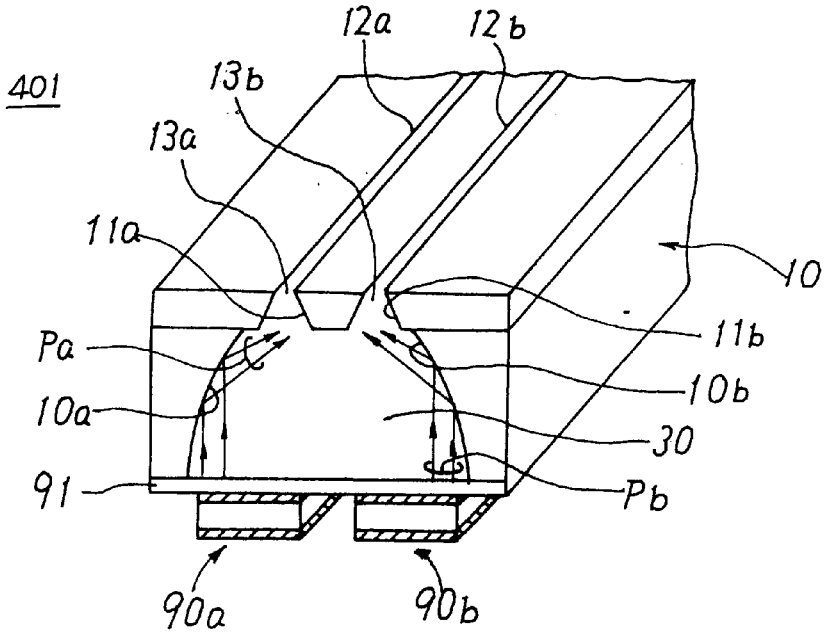
FIG. 9 is a sectional perspective view showing another construction according to embodiment 4 of the invention.

FIG. 9 is a sectional perspective view showing a construction of an ink jetting apparatus 401 according to embodiment 4 of the invention. In this embodiment, as compared with the ink jetting apparatus 302 shown in FIG. 7 in the foregoing embodiment 3, the piezoelectric transducer 90 is replaced with a pair of flat plate-shaped piezoelectric transducers 90*a* and 90*b*, and the combination of the nozzle 11 and the opening 12 is replaced with two combinations of nozzles 11*a* and 11*b* and openings 12*a* and 12*b*. However, the inner faces 10*a* and 10*b* of the ink tank 10 have different focuses 13*a* and 13*b*, and they are arranged in the vicinity of the nozzles 11*a* and 11*b*. Therefore, as compared with the ink jetting apparatus 302, the inner faces 10*a* and 10*b* are away from each other by a distance equivalent to that between the openings 12*a* and 12*b*.

Number of the openings is increased and the longitudinal waves are converged also in this manner, and it is possible to obtain the same advantage as in the ink jetting apparatus 400. In addition, it is also preferred to use the piezoelectric transducer 90 formed in one unit instead of the piezoelectric transducers 90*a* and 90*b*. In this case, the ultrasonic wave given from the flat plate 96*c* to the ink 30 might cause a disturbance, but it can be practically ignored depending upon the design conditions.

Embodiment 5

Figure 10:
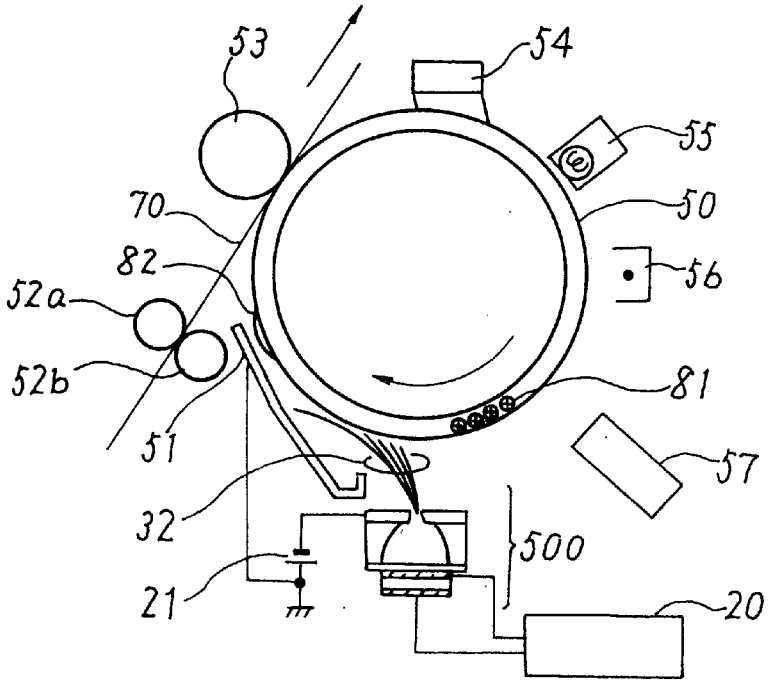
FIG. 10 is a sectional view showing a construction according to embodiment 5 of the invention.

FIG. 10 is a sectional view showing a construction of an electrostatic latent image developing apparatus according to embodiment 5 of the invention. It is possible to adopt the ink jetting apparatus shown in the foregoing embodiment 1 to embodiment 4 in this electrostatic latent image developing apparatus. In the drawing, a construction indicated as an ink jetting apparatus 500 illustrates the same construction as the ink jetting apparatus 302, and it is possible to adopt any of the ink jetting apparatus shown in the foregoing embodiments 1 to 4 as the ink jetting apparatus 500. In this sense, it is to be understood that the ink jetting apparatus 500 is comprehensive.

A photosensitive drum 50 rotates clockwise in the drawing as indicated by an arrow, and is treated in sequential order by a cleaning unit 54, a discharge unit 55, a charge unit 56, and an exposure unit 57. Owing to these treatments, a positively charged electrostatic latent image 81 is formed on the photosensitive drum 50, and is developed into an ink image 82 by applying liquid-drop flow 32 of ink jetted from the ink jetting apparatus 500 onto the electrostatic latent image 81. However, as the ink is supplied from the ink jetting apparatus 500 to the electrostatic latent image formed on the rotary drum 50, it is preferred to extend the nozzle in the direction parallel to the axis of rotation of the rotary drum 50.

In the meantime, a recording paper 70, being guided by conveyor rollers 52*a* and 52*b*, is pressed onto the photosensitive drum 50 by a pressing roller 53, and conveyed. in this manner, the ink image 82 is transferred onto the recording paper 70.

After the recording paper 70 is pressed, the ink image 82 remaining on the photosensitive drum 50 is removed by the cleaning unit 54, and the charge distributed on the photosensitive drum 50 is also removed by the discharge unit 55. For example, the distributed charge is removed by irradiating light and temporarily decreasing resistivity of the photosensitive drum 50. Thereafter, the photosensitive drum 50 is further charged by the charge unit 56, light is scanned by the exposure unit 57 on the basis of a picture to be recorded, and the electrostatic latent image 81 is formed.

Figure 11:
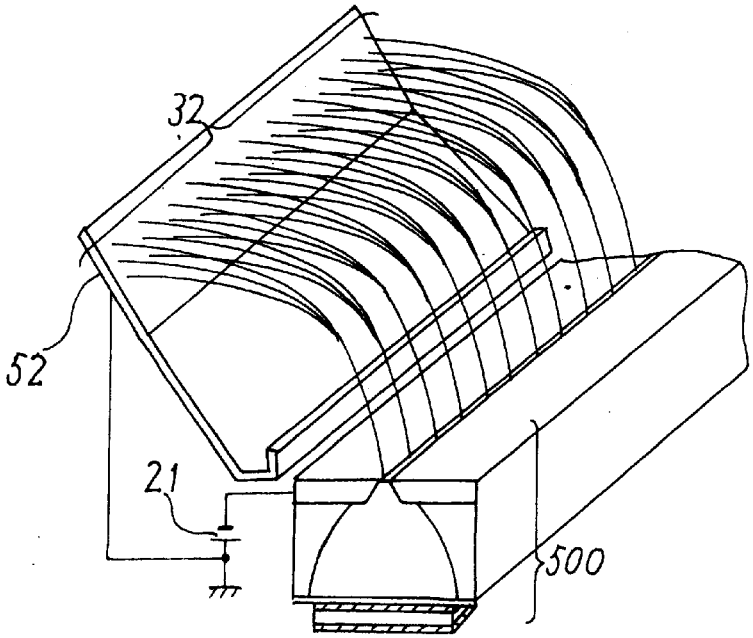
FIG. 11 is a sectional view showing the construction according to embodiment 5 of the invention.

The ink jetting apparatus 500 supplies the photosensitive drum 50 with the liquid-droop flow 32 of ink regardless of existence of the electrostatic latent image 81. For this reason, a capture plate 51 is disposed in order to capture an ink portion that did not contribute to the formation of the ink image 82. For example, it is possible to dispose the capture plate 51 at a place on the traveling direction side of the photosensitive drum 50 nearer than the ink jetting apparatus 500. FIG. 11 is a perspective view showing the construction of the ink jetting apparatus 500 and the vicinity of the capture plate 51.

In addition, when the ink is conductive, it is preferred to arrange a dc power source 21 for applying a positive potential to the capture plate 51 and a negative potential to the ink jetting apparatus 500 respectively. This is because it is preferred that the electrostatic latent image 81 is charged positively and that the liquid-drop flow 32 of ink to be applied is charged negatively. And because it is further preferred that the capture plate 51 for capturing the ink portion that did not contribute to the formation of the ink image 82 electrostatically attracts the negatively-charged liquid-drop flow 32 of ink. As a matter of course, it is possible to construct, for example, the charge unit 56 in order to charge negatively the electrostatic latent image 81, and in that case, positive and negative of the dc power source 21 should be reversed.

In this manner, it is possible to directly apply a potential to the ink jetting apparatus 500, and unlike the charging by the grid electrode, it is advantageous that cleaning thereof is not necessary.

In addition, when adopting ink of insulating characteristic, it is not necessary to dispose any dc power source 21, but the application of ink to the electrostatic latent image 81 still remains unchanged. This is because the ink is still polarized by the electric field of the electrostatic latent image 81 and attracted to the electrostatic latent image 81.

As described above, since the electrostatic latent image developing apparatus according to this embodiment performs a development using one of the ink jetting apparatus according to the foregoing embodiments 1 to 4, particle size of the liquid-drops of ink is small and uniform and can be produced in large amount. This eventually makes it possible to carry out a development of high-speed and high-density without scumming, fog, and unevenness.

A case wherein the electrostatic latent image is formed on the rotary drum has been described in this embodiment, and the apparatus can be also applied to a latent image carrier traveling straight in one direction. In this case, it is preferred that the traveling direction of the latent image carrier and the extending direction of the nozzle of the ink jetting apparatus 500 cross each other making a right angle.

It is a matter of course that the ink jetting apparatus according to the foregoing embodiments 1 to 4 are not limited to an application to the electrostatic latent image developing apparatus described in this embodiment. Because it is possible to express any density regardless of the existence of the electrostatic latent image by controlling the burst signals BS, and any desired picture can be thus drawn and printed.

Embodiment 6

The foregoing embodiments 1 to 4 show the ink jetting apparatus in which the longitudinal wave P propagates to the opening 12, the surface wave Q excited from the end portion is formed due to the restoring force caused by the surface tension of the ink, and the ink 30 is jetted from the opening 12 on the basis of the surface wave Q. However, in such a system, there is a possibility that a second surface wave, which produces liquid-drops of larger particle size, is generated other than the surface wave Q, when there is an increase in the aspect of number n of pulses included in one lump of the burst signals BS, amplitude thereof, and/or the burst frequency fb. In the following description, the production principal is described at first, and then a construction for preventing such liquid-drops of large particle size from contributing to the formation of the ink image 82 is described.

Figure 12:
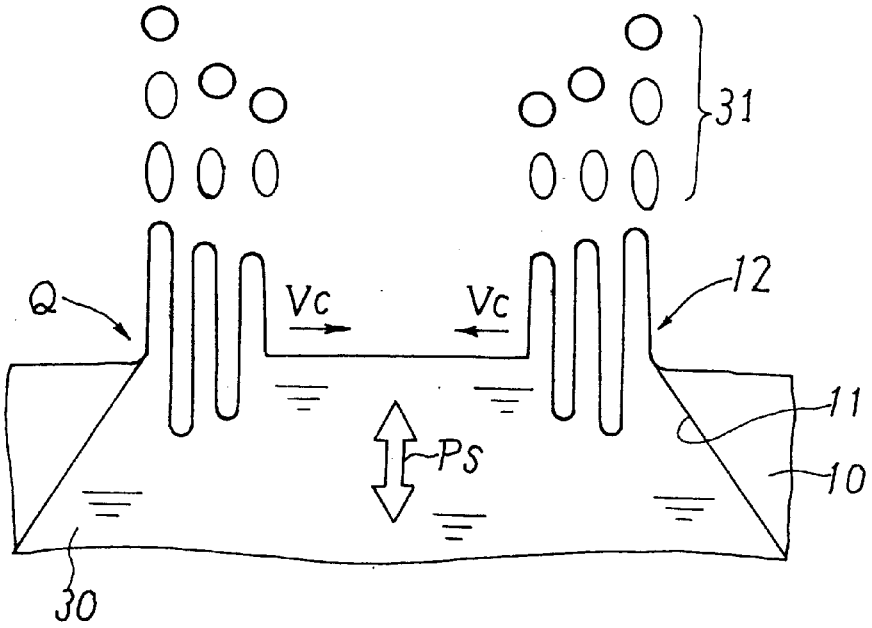
FIG. 12 is a schematic sectional view showing a background according to embodiment 6 of the invention.
Figure 13:
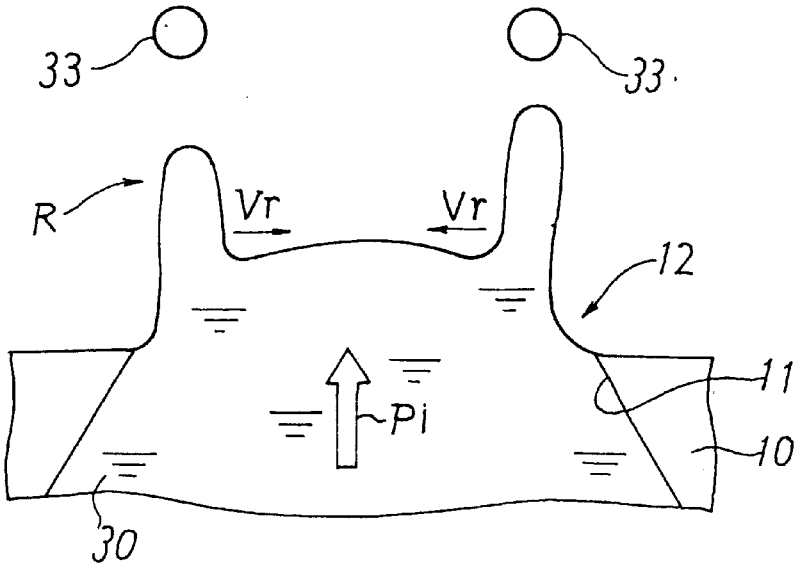
FIG. 13 is a schematic sectional view showing the background according to embodiment 6 of the invention.

(I) The Principle of Generation of the Liquid-Drops of Large Particle Size:

FIG. 12 and FIG. 13 are schematic sectional views showing the concepts of the sound pressure Ps and the radiation pressure Pi respectively. When the piezoelectric transducer 90 applies a vibration to the ink 30 with the basic frequency fa, the sound pressure Ps of the frequency fa drives almost vertically the liquid surface of the ink 30 exposed at the opening 12 in two directions as shown in FIG. 12. As described above, edge of the opening 12 functions as a fixed end for the liquid surface of the ink 30, and therefore the first surface wave Q is generated from the edge of the opening 12. This first surface wave Q travels toward the center of the opening 95 at the velocity Vc, but rapidly attenuates and disappears when the application of the vibration of the piezoelectric transducer 90 stops as described above.

On the other hand, the ink 30 has a boundary with air in the vicinity of the opening 12 and the vibration of the ink reflects fully at the boundary, and therefore the radiation pressure Pi drives almost vertically the liquid surface of the ink 30, only in one direction from the piezoelectric transducer 90 toward the opening 12. The radiation pressure Pi disappears when the application of vibration of the piezoelectric transducer 90 stops, and a second surface wave R is generated from the edge of the opening 12. This second surface wave R travels toward the center of the opening 12 at a velocity Vr.

Figure 14:
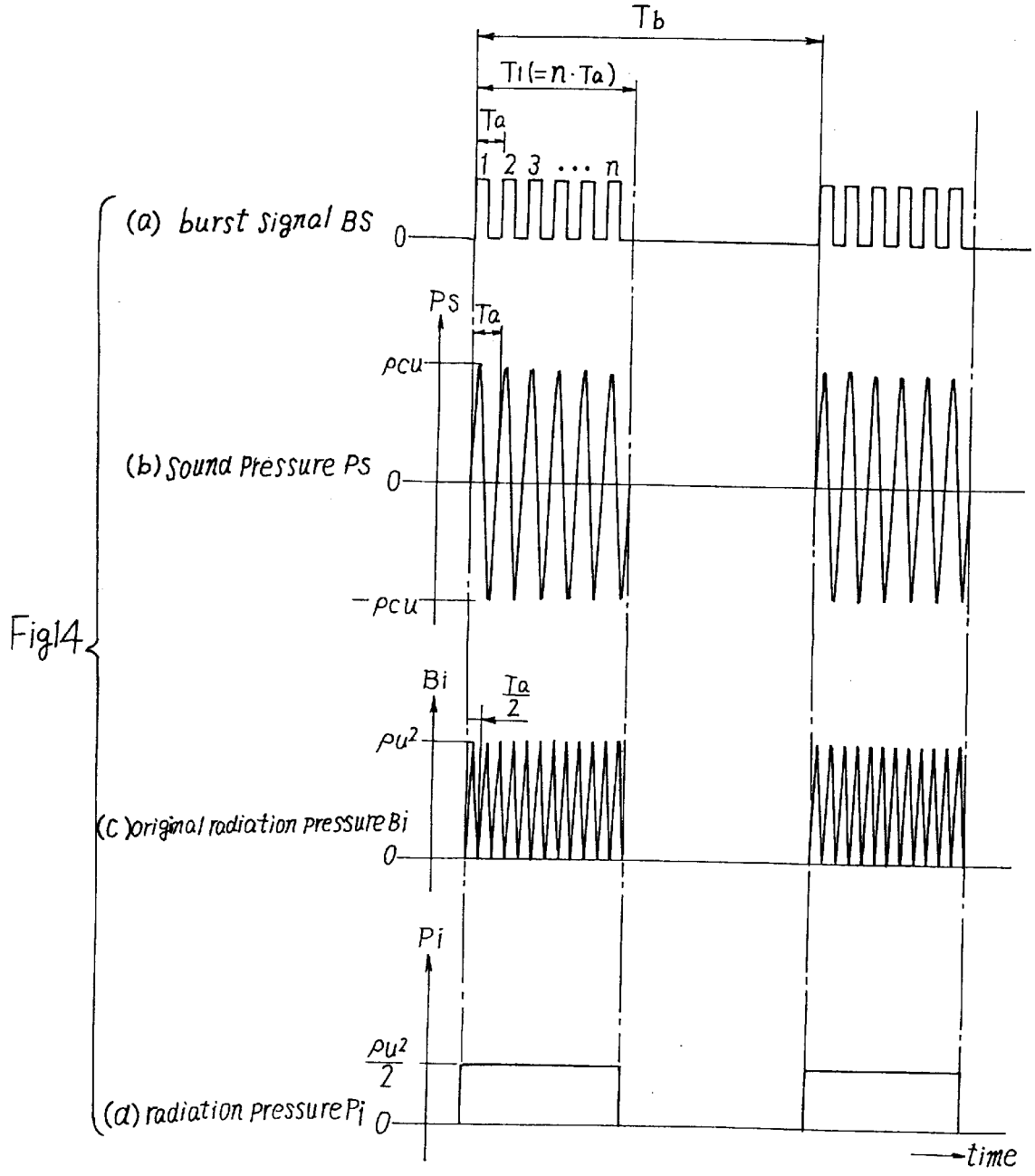
FIGS. 14(*a*)–14(*d*) are waveform diagrams showing the background according to embodiment 6 of the invention.

FIGS. 14(*a*)–14(*d*) are waveform diagrams showing a relation among the burst signals Bs, the sound pressure Ps, and the radiation pressure Pi. A pulse train included in the burst signals BS has a period of Ta=1/fa, and each burst signal Bs is composed of a lump of n pulses. It is established that the burst period Tb is not smaller than (n+1) Ta, for example, and accordingly there is a distance $Tb-n \cdot Ta>0$ between the burst signals BS adjacent to each other.

The piezoelectric transducer 90 receives the burst signals Bs and generates an approximately sine-wave-shaped thickness longitudinal vibration. It is herein assumed that the ink 30 has a low viscosity in which the ink ideally follows the vibration applied by the piezoelectric transducer 90. And establishing that speed of sound (sonic velocity) propagating in the ink 30, maximum value of the speed (maximum flow velocity) at which the ink 30 itself travels owing to the applied vibration, and density of the ink 30 as c, u, and ρ respectively, the sound pressure Ps shows a sine wave of a period Ta and an amplitude ρ cu. Assuming that the pressure in the case in which any vibration is not applied to the ink 30 is 0, the sound pressure Ps varies within the range of ±ρ cu and drives the ink 30 in the two directions as shown in FIG. 12. The plus sign is used herein in the direction from the piezoelectric transducer 90 to the opening 12.

On the other hand, a sine-wave-shaped original radiation pressure Bi of a period Ta/2 and an amplitude $\rho u^2/2$ is generated by fully reflecting the vibration of the ink 30 at the boundary of the ink 30 with air in the vicinity of the opening 12. The original radiation pressure Bi changes from pressure 0 to $\rho u^2$. The maximum flow velocity u of the ink 30 is small as compared with the sonic velocity c, and therefore amplitude itself of the original radiation pressure Bi does not greatly influence behavior of the ink 30 when the sound pressure Ps is applied. However, the original radiation pressure Bi has an average value $\rho u^2/2$ during a period T1=n·Ta in which the burst signals BS exist. The radiation pressure Pi is applied only in one direction as a pulse having this average value, and when vibration is added to the ink 30 continuously for a long time, meniscus of the ink 30 at the opening 12 rises greatly. The original radiation pressure Bi disappears when the sound pressure Ps is not applied between the burst signals BS adjacent to each other.

The foregoing shows that the radiation pressure Pi gives a vibration to the liquid surface of the ink 30 at the burst period Tb and gives the second surface wave R to the ink 30. It is understood that with increase in the maximum flow velocity u of the ink 30 itself, the radiation pressure Pi is increased and the amplitude of the second surface wave R is also increased. It is also understood that when the number n of pulses included in one lump of the burst signals BS and the burst frequency fb increase, the period in which the radiation pressure Pi is applied to the ink 30 becomes longer as compared with the term of not applying it, whereby the amplitude of the second surface wave R also increases. Moreover, the second surface wave R depends not on the sound pressure Ps of the period Ta but on the radiation pressure Pi of the burst period Tb, and therefore particle size of the liquid-drops 33 flying from the opening 12 due to the second surface wave R is large. In this specification, obtaining the liquid-drops 31 from the opening 12 on the basis of the (first) surface wave Q is expressed as "jetting", and obtaining the liquid-drops 33 from the opening 12 on the basis of the second surface wave R is expressed as "emitting".

Figure 15:
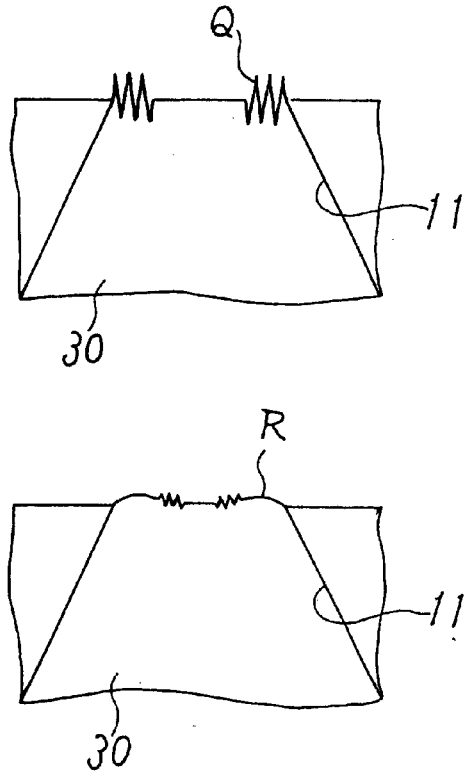
FIGS. 15(*a*) and 15(*b*) are schematic views showing the background according to embodiment 6 of the invention.

When the number n of pulses, the amplitude thereof, and the burst frequency fb increase and the amount of the emitted liquid-drops 33 increases, then amount of the jetted liquid-drops 31 increases. FIG. 15(*a*) to FIG. 18(*b*) are schematic views each showing a condition of the liquid surface of the ink 30 in the vicinity of the opening 12 in the case wherein the amplitude of the burst signals BS is gradually increased in this order. In every drawings, (a) shows a condition immediately after a lump of pulses has been applied, i.e., a point of time after passing period n·Ta from the beginning of the application of the lump of pulses. And (b) shows a condition after the lump of pulses has been applied and immediately before the next lump of pulses is applied, i.e., a point of time after passing a period Tb from the beginning of the application of the lump of pulses.

In the condition shown in FIGS. 15(*a*) and 15(*b*), amplitude of the surface wave Q is small, ink does not separate from the ink 30 as the liquid-drops 31, and any jetting does not take place. In this case, amplitude of the second surface wave R is also small, and any emitting does not take place, either.

Figure 16:
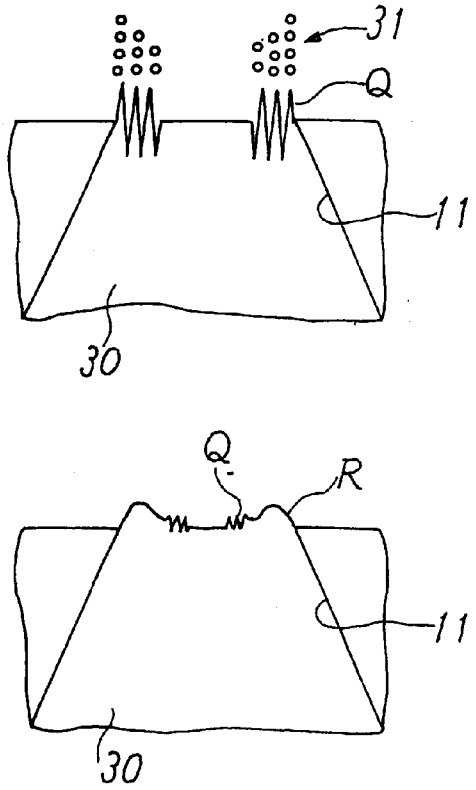
FIGS. 16(*a*) and 16(*b*) are schematic views showing the background according to embodiment 6 of the invention.

In the condition shown in FIGS. 16(*a*) and 16(*b*), amplitude of the surface wave Q is large to the extent of separating ink from the ink 30 as the liquid-drops 31 and generating the jetting. But the amplitude of the second surface wave R is still small, and emitting does not take place. This condition is hereinafter referred to as "appropriate jetting condition".

In the condition shown in FIGS. 17(*a*) and 17(*b*), amplitude of the surface wave Q is increased and a lot of liquid-drops 31 are jetted as compared with the condition shown in FIG. 16. However, amplitude of the second surface wave also increases, and the liquid-drops 33 of large particle size are emitted additionally. This condition is hereinafter referred to as "over-jetting condition".

Figure 18:
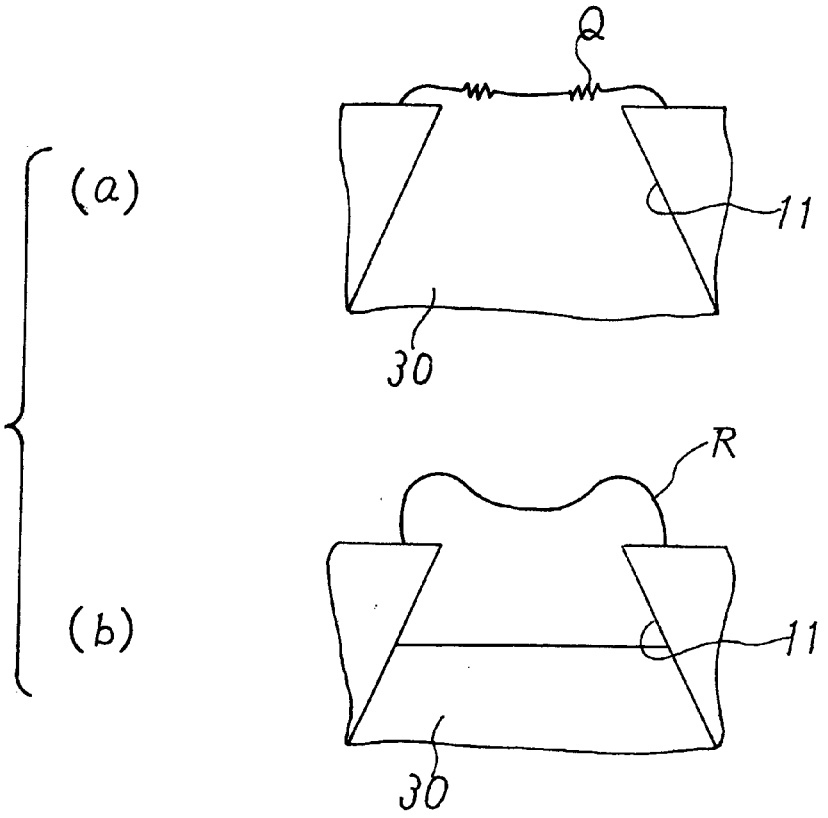
FIGS. 18(*a*) and 18(*b*) are schematic views showing the background according to embodiment 6 of the invention.

In the condition shown in FIGS. 18(*a*) and 18(*b*), the force due to the radiation pressure to push up the liquid surface of the ink 30 is stronger than the force of the surface tension to maintain the liquid surface, and the ink 30 flows out of the nozzle 11. In this condition, the liquid surface of the ink 30 is not fixed at the edge of the opening 12, and therefore generation efficiency of both surface waves Q and R considerably decreases, and neither jetting of the liquid-drops 31 nor emitting of the liquid-drops 33 does not take place.

Figure 19:
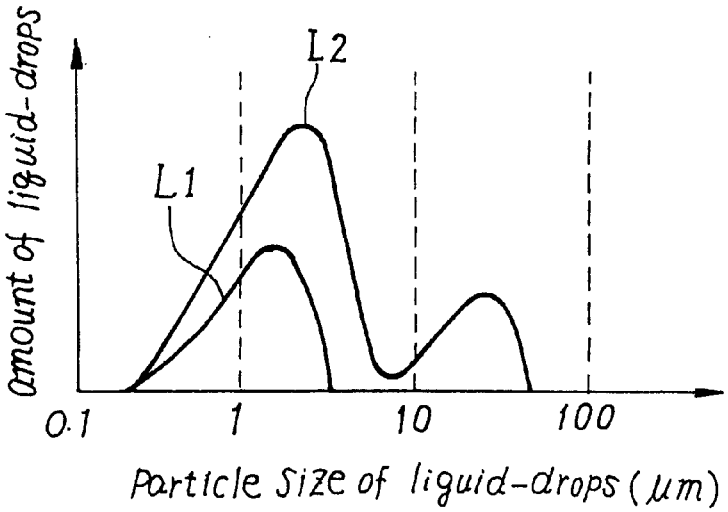
FIG. 19 is a graph showing the background according to embodiment 6 of the invention.

FIG. 19 is a graph showing a relation between particle size of the liquid-drops and amount of the liquid-drops, and curves L1 and L2 show the appropriate jetting condition and the over-jetting condition, respectively. The conditions shown in FIG. 15 and FIG. 18 are not illustrated because the liquid-drops are neither emitted nor jetted.

The curve L1 shows that only liquid-drops of approximately $\mu$m in particle size are jetted, and the curve L2 shows that not only those liquid-drops of approximately several $\mu$m in particle size are jetted but also those liquid-drops of more than 10 $\mu$m in particle size are emitted. It is understood that the amount of jetted liquid-drops of approximately several $\mu$m is larger in the over-jetting condition wherein liquid-drops of more than 10 $\mu$m in particle size are also emitted, than in the appropriate jetting condition.

Figure 20:
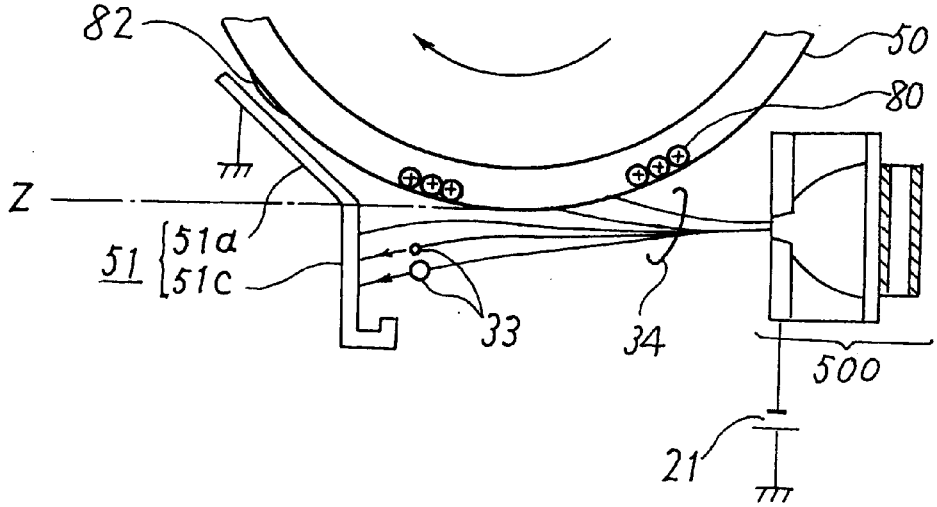
FIG. 20 is a sectional view showing a construction according to embodiment 6 of the invention.

(II) Construction for Excluding Liquid-Drops of Large Particle Size:

FIG. 20 is a sectional view showing the ink jetting apparatus 500 and the vicinity of the photosensitive drum 50 in the construction of the electrostatic latent image developing apparatus according to the invention. It is possible to arrange the remaining portion of the construction to be similar to that shown FIG. 10. The ink jetting apparatus shown in the foregoing embodiments 1 to 4 can be used as the ink jetting apparatus 500, and are suitable in the foregoing over-jetting condition.

In this electrostatic latent image developing apparatus, the liquid-drop flow 34 is supplied from the ink jetting apparatus 500 deviating from the direction toward the photosensitive drum 50. More specifically, the liquid-drop flow 34 flows approximately in parallel to the tangential direction on which the photosensitive drum 50 travels. The liquid-drop flow 34 includes not only the liquid-drops 31 jetted from the ink jetting apparatus 500 but also the emitted liquid-drops 33.

The liquid-drop flow 34 is polarized by electric field due to the electrostatic latent image 81 or negatively charged by the dc power source 21, and is attracted to the electrostatic latent image 81. At this time, as the liquid-drops 31 have a small particle size, inertia force is small in the early stage of the jetting, and therefore the liquid-drop flow 34 is easily attracted to the electrostatic latent image 81. On the contrary, the liquid-drops 33 have a large particle size, inertial force is large in the early stage of the jetting, and therefore they are not easily attracted to the electrostatic latent image 81. The liquid-drop flow 34 flows approximately in parallel to the tangential direction on which the photosensitive drum 50 travels, and therefore ratio of the large liquid-drops 33 contributing to the formation of the ink image 82 is decreased.

In this manner, the large liquid-drops 33 do not contribute to the formation of the ink image 82 in the over-jetting condition, and it is possible to increase the jetting amount of small liquid-drops 31 and perform a high-speed and high-density development without scumming and fog.

Moreover, in this embodiment, as the liquid-drop flow 34 flows almost horizontally right below the photosensitive drum 50, and it is therefore possible to efficiently exclude the large liquid-drops 33. The capture plate 51 has a portion 51*c* on the side farther from the photosensitive drum 50 than a tangent Z of the photosensitive drum 50 in the flowing direction of the liquid-drop flow 34 (lower portion in the drawing), and a portion 51*d* on the nearer side. The portion 51*c* is farther than the portion 51*d* from the photosensitive drum 50. The liquid-drops 33, which are large in particle size and large in volume accordingly, have an amount of negative charge larger than that of the liquid-drops 31. Therefore, the capture plate 51 positively charged against the liquid-drop flow 34 performs a function of effectively separating the large liquid-drops 33 from the photosensitive drum 50 and effectively guiding the small liquid-drops 31 to the photosensitive drum 50.

Embodiment 7

Figure 21:
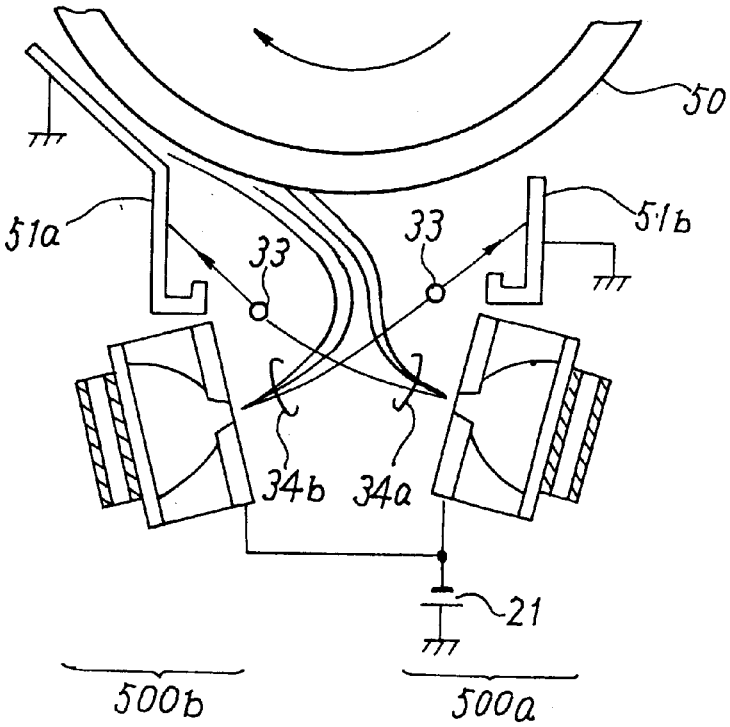
FIG. 21 is a sectional view showing a construction according to embodiment 7 of the invention.

FIG. 21 is a sectional view showing a part of a construction of the electrostatic latent image developing apparatus according to the invention. In this electrostatic latent image developing apparatus, the liquid-drops 34*a* and 34*b* are respectively supplied from the ink jetting apparatus 500*a* and 500*b* deviating from the direction toward the photosensitive drum 50. More specifically, the liquid-drop flow 34*a* flows to approximately in parallel to a tangential direction on which the photosensitive drum 50 travels, and the liquid-drop flow 34*b* flows approximately in parallel to a direction opposite to the tangential direction on which the photosensitive drum 50 travels. The liquid-drop flows 34*a* and 34*b* include not only the jetted liquid-drops 31 but also emitted liquid-drops 33. The ink jetting apparatus shown in the -foregoing embodiments 1 to 4 can be used as the ink jetting apparatus 500*a* and 500*b*, and they are suitable in the foregoing over-jetting condition.

The ink jetting apparatus 500*a* and 500*b* are both arranged to have an inclination so that their openings are directed to the photosensitive drum 50 from positions opposite to each other. The capture plates 51*a* and 51*b* are arranged at positions facing to the ink jetting apparatus 500*a* and 500*b* respectively. A dc power source 21 gives a negative potential to both of the ink jetting apparatus 500*a* and 500*b* against the capture plates 51*a* and 51*b*. Other portions of the construction can be similar to those shown in FIG. 10.

In this embodiment, the liquid-drop flows 34*a* and 34*b* cross each other before they reach the photosensitive drum 50. The liquid-drops 31 of small particle size are thus blown onto the photosensitive drum 50 largely changing their ways. On the other hand, the liquid-drops 33 of large particle size have a large inertia force, and therefore they travel approximately straight not largely changing their ways, and are collected by the capture plates 51*a* and 51*b* without reaching the photosensitive drum 50. Particularly when the liquid-drop flows 34*a* and 34*b* are charged, they repel and do not attach to each other.

As described above, in this embodiment, it is possible to conduct a development of high-density only with liquid-drops of small particle size.

Embodiment 8

Figure 22:
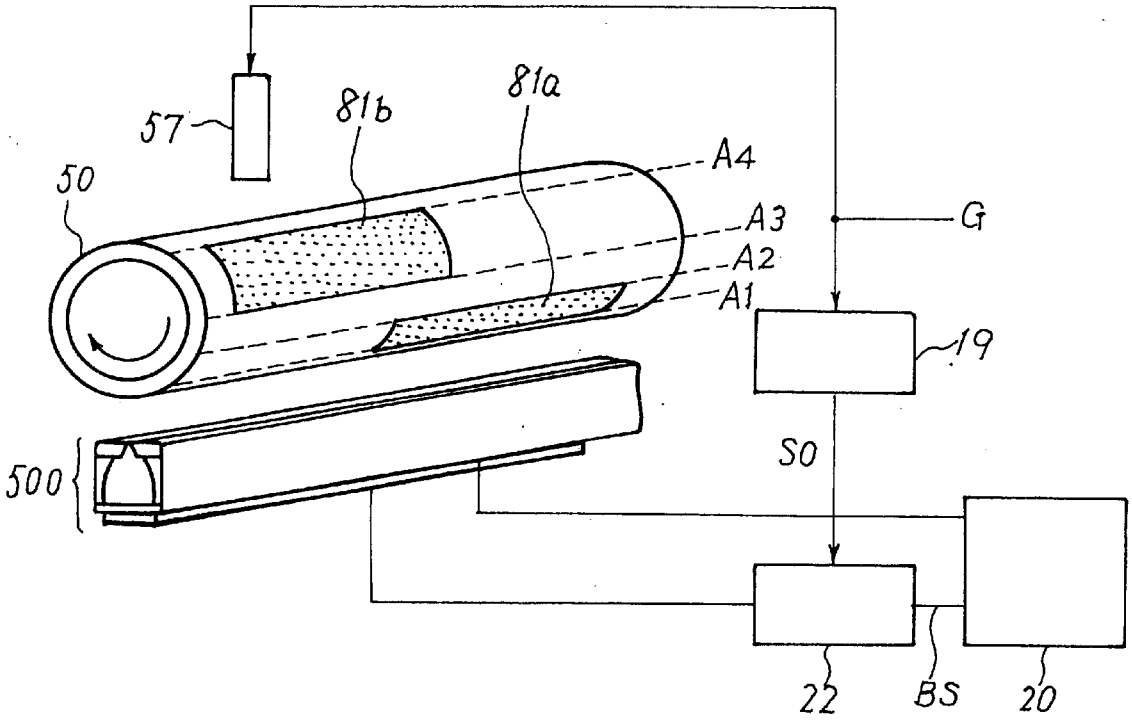
FIG. 22 is a sectional view showing a construction according to embodiment 6 of the invention.

FIG. 22 is a sectional view showing a part of the construction of the electrostatic latent image developing apparatus according to the invention. Ink is supplied from the ink jetting apparatus 500 to the photosensitive drum 50 in order to contribute to the development of an electrostatic latent image. However, depending upon pictures and letters to be developed, application of ink is not necessary at all in some regions such as blank space of a manuscript. In this embodiment, ink is supplied only to the electrostatic latent image in the region where ink should be applied.

The exposure unit 57 for forming electrostatic latent image on the photosensitive drum 50 controls exposure on the basis of a picture signal G. A picture information processing apparatus 19 inputs this picture signal G and outputs a signal S0 to distinguish a region where application of ink is not necessary from a region where ink should be applied. The signal S0 is given to a switch 22 interposed between the drive 20 and the ink jetting apparatus 500. The switch 22 intermittently supplies the burst signals BS to the ink jetting apparatus 500.

In FIG. 22, positions A1, A2, A3, and A4 are established in order in a direction opposite to the traveling direction on the photosensitive drum 50. Regions 81*a* and 81*b* where ink should be applied are located in the positions A1 to A2 and the positions A3 to A4, respectively. The photosensitive drum 50 is rotating, and it is possible to make these positions A1, A2, A3, and A4 correspond to times t1, t2, t3, and t4 respectively. That is to say, the picture signal G has information that application of ink is not necessary at all before the time t1, from the time t2 to the time t3, and immediately after the time t4.

Figure 23:
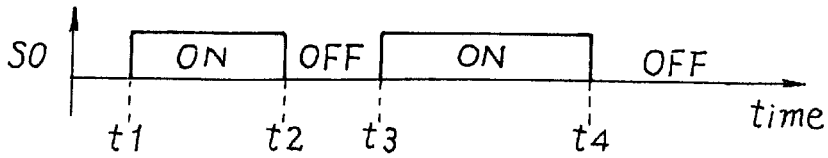
FIG. 23 is a graph showing an operation according to embodiment 7 of the invention.

FIG. 23 is a graph showing the signal S0. A picture information processing apparatus 19 turns the switch 22 off immediately before the time t1, from the time t2 to the time t3, and immediately after the time t4, and turns it on during period other than the mentioned times, i.e., from the time t1 to the time t2 and from the time t3 to the time t4. The terms "ON" and "OFF" in FIG. 23 show the operation of the switch 22. Owing to such control, the burst signals BS are not applied to the ink jetting apparatus 500 at the timing for the regions where application of ink is not necessary. As a result, it is possible to avoid any wasteful supply of ink and improve economic efficiency.

Especially when using the apparatus shown in the foregoing embodiments 1 to 4 as the ink jetting apparatus 500, response characteristic for jetting ink is superior and on/off control is satisfactory as described at the ending portion of the description about embodiment 1. As a result, the apparatus is suitable for the foregoing control.

In addition, it is possible to build the switch 22 into the drive 20.

Embodiment 9

Figure 24:
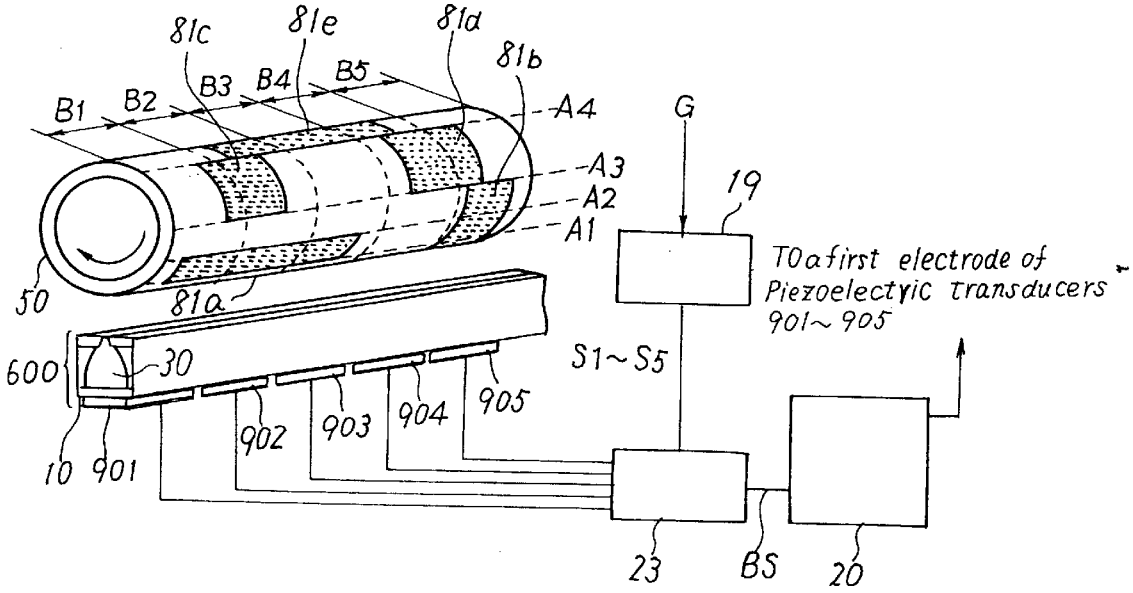
FIG. 24 is a sectional view showing a construction according to embodiment 9 of the invention.

FIG. 24 is a sectional view showing a part of the construction of the electrostatic latent image developing apparatus according to the invention. This apparatus is different from the electrostatic latent image developing apparatus shown in FIG. 22 in the aspect that the ink jetting apparatus 500 is replaced with an ink jetting apparatus 600 and the switch 22 is replaced with a switch 23. It is possible to build the switch 23 into the drive 20.

The ink jetting apparatus 600 is provided with a plurality of piezoelectric transducers, for example, piezoelectric transducers 901, 902, 903, 904, and 905 divided into five blocks arranged along the direction of the axis of rotation of the photosensitive drum 50. They are arranged in contact with the ink tank 10 which is single or corresponds to the piezoelectric transducers 901 to 905 divided into five blocks. And the longitudinal wave P is applied to the ink 30 stored in the ink tank 10 as well as in preferred embodiment 1 to 4.

The drive 20 is connected to the piezoelectric transducers 901 to 905 through the switch 23. And the switch 23 intermittently supplies the burst signals BS to the piezoelectric transducers 901 to 905 on the basis of signals S1, S2, S3, S4, and S5 formed by the picture information processing apparatus 19 on the basis of the picture signal G.

In FIG. 24, the positions A1, A2, A3, and A4 are defined in order in a direction opposite to the traveling direction on the photosensitive drum 50. Zones B1, B2, B3, B4, and B5 are defined corresponding to the piezoelectric transducers 901, 902, 903, 904, and 905, respectively. The region 81*a* where ink should be applied is located from the zone B1 to the zone B3. Therefore, development of the electrostatic latent image in this region 81*a* is conducted with ink excited and jetted by the piezoelectric transducers 901, 902, and 903. Likewise, the regions 81*b*, 81*c*, 81*d*, and 81*e* are located in the zone B5, the zones B1 to B2, the zones B4 to B5, and the zones B2 to B4 respectively. And development is conducted with ink excited and jetted by the piezoelectric transducer 905, the piezoelectric transducers 901 and 902, the piezoelectric transducers 904 and 905, and the piezoelectric transducers 902, 903, and 904 respectively.

The regions 81*a*, 81*b*, 81*c*, 81*d*, and 81*e* are located in the positions A1 to A2, the positions A1 to A3, the positions A3 to A4, the positions A3 to A4, and on the opposite side of the traveling direction from the position A4, respectively. Therefore, the periods during which the switch 23 gives the burst signals BS to the piezoelectric transducers 901, 902, 903, 904, and 905 are from the time t1 to the time t2 and from the time t3 to the time t4, from the time t1 to the time t2 and after the time t3, from the time t1 to the time t2 and after the time t4, after the time t3, and from the time t1 to the time t4, respectively.

Figure 25:
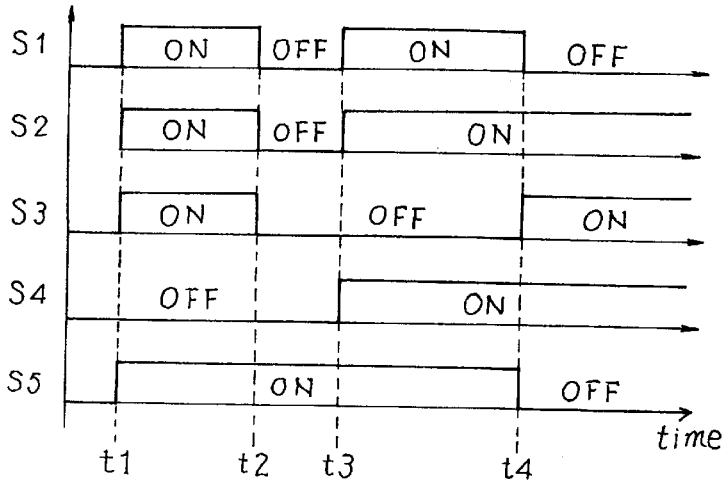
FIG. 25 is a graph showing an operation according to embodiment 9 of the invention.

FIG. 25 is a graph showing the signals S1 to S5. The terms "ON" and "OFF" in the drawing show the foregoing operation of the switch 23.

In this manner, ink is supplied dividedly also in the direction of the axis of rotation of the photosensitive drum 50, and this improves economic efficiency.

The art, wherein an electrostatic latent image is developed by dividing regions in the traveling direction and in the direction of the axis of rotation of the photosensitive drum, is publicly known by the Japanese Patent Publication (unexamined) No. 4-319977, for example. However, the response characteristic for ON/OFF of the burst signals BS in supplying the ink 30 to the photosensitive drum 50 becomes superior as a result of adopting the ink jetting apparatus of the foregoing embodiments 1 to 4 as the ink jetting apparatus 500 and 600. In other words, the ink jetting apparatus according to embodiments 1 to 4 are especially suitable for the development of the electrostatic latent image by dividing the regions in the traveling direction and in the direction of the axis of rotation of the photosensitive drum.

Embodiment 10

Figure 26:
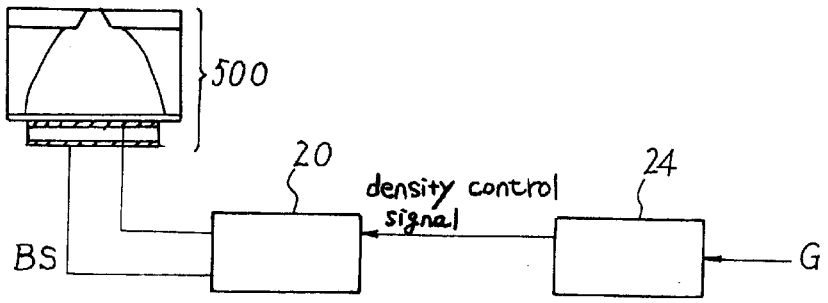
FIG. 26 is a block diagram showing an embodiment 10 of the invention.

FIG. 26 is a block diagram showing a control portion of the ink jetting apparatus 500 according to this embodiment. In FIG. 26, a sectional view of the ink jetting apparatus 302 shown in FIG. 7 is illustrated as the construction of the ink jetting apparatus 500, and it is also preferred to use any of the ink jetting apparatus of the foregoing embodiments 1 to 4.

A picture information processing apparatus 24 forms a density control signal on the basis of the picture signal G. The drive 20 controls amplitude of the burst signals BS, number of pulses in one lump, and burst period on the basis of the density control signal, and causes the ink jetting apparatus 500 to jet an amount of ink appropriate for the density of the picture to be developed.

Figure 27:
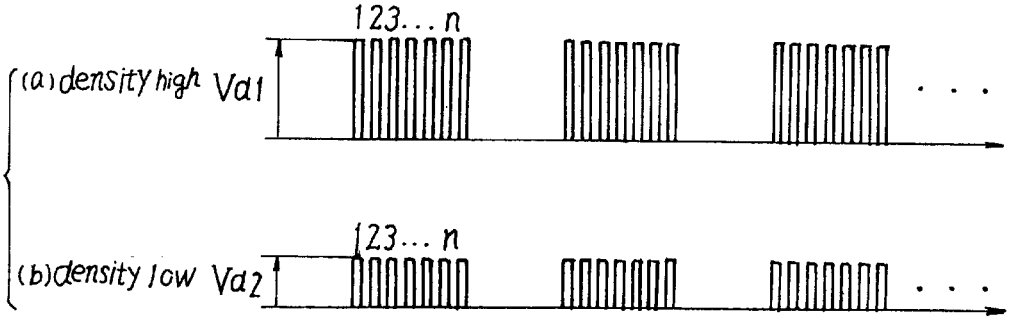
FIGS. 27(*a*) and 27(*b*) are graphs showing the operation according to embodiment 10 of the invention.

FIGS. 27(*a*) and 27(*b*) are graphs illustrating a case of controlling the amplitude of the burst signals BS. When the amplitude of the burst signals BS is increased, the sound pressure Ps shown in FIG. 12 is also increased, whereby it becomes possible to correspond to higher density. That is to say, the amplitude Vd1 of the burst signals BS corresponding to a high density is larger than the amplitude Vd2 of the burst signals BS corresponding to a low density.

Figure 28:
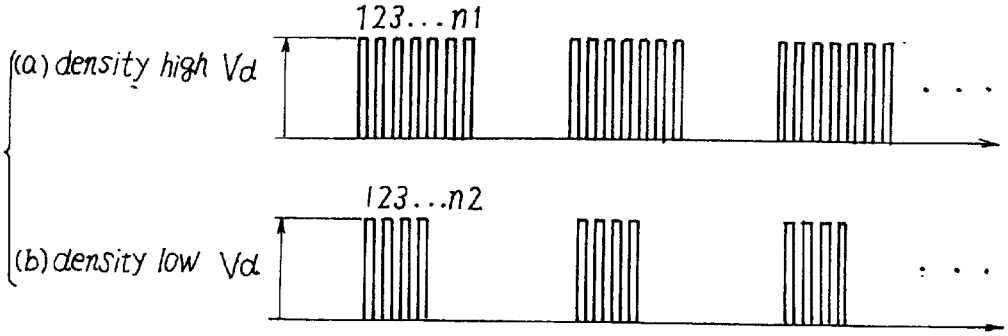
FIGS. 28(*a*) and 29(*b*) are graphs showing the operation according to embodiment 10 of the invention.

FIGS. 28(*a*) and 28(*b*) are graphs illustrating a case of controlling number n of pulses of the burst signals BS. When pulse number n forming one lump of the burst signals BS is increased, more loops of the surface save Q shown in FIG. 12 exist on the liquid surface, and it is possible to correspond to a higher density. That is to say, pulse number n1 of the burst signals BS corresponding to a high density is larger than the pulse number n2 of the burst signals BS corresponding to a low density.

Figure 29:
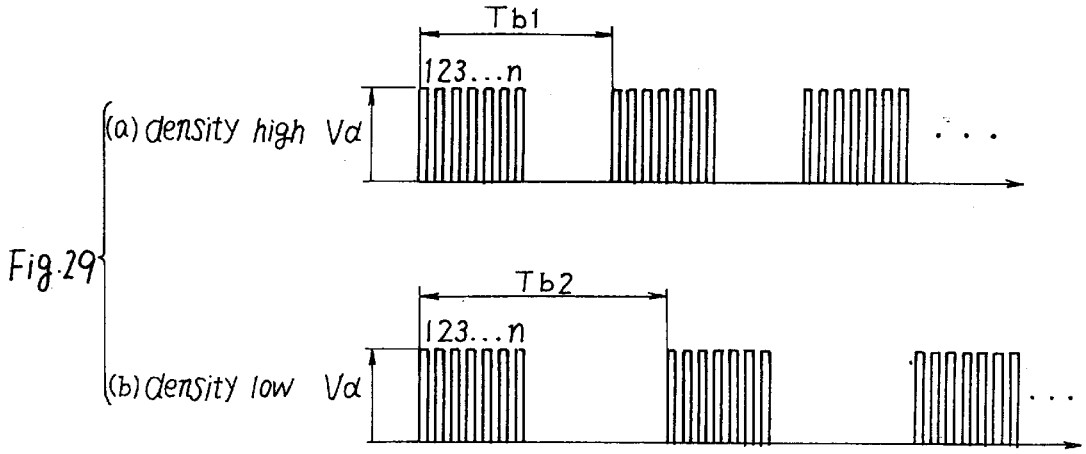
FIGS. 29(*a*) and 29(*b*) are graphs showing the operation of preferred embodiment 10 of the invention.

FIGS. 29(*a*) and 29(*b*) are graphs illustrating a case of controlling the burst period Tb of the burst signals BS. As the burst period Tb of the burst signals BS is longer, more loops of the surface wave Q exist in a fixed time, and it is possible to correspond to a higher density. That is to say, the burst period Tb1 of the burst signals BS corresponding to a high density is longer than the burst period Tb2 of the burst signals BS corresponding to a low density.

As described above, in this embodiment, amount of ink jetted in a unit time is controlled by controlling the waveform of the burst signals BS outputted from the drive 20. It is therefore possible to establish any density according to picture, or further obtain a picture of many gradations by establishing the density for each of plural pictures wherein required density is different and by printing them on a recording paper repeatedly for each picture.

As has been described so far, in the liquid jetting apparatus according to the invention, it is possible to jet the liquid-drops of small particle size, which does not vary widely, by generating the surface wave, which does not interfere with each other, on the liquid surface of the jetting spout. It is therefore possible to restrain scumming and fog when the apparatus is used for printing and developing a latent image. It is also possible to jet a large amount of ink by controlling the sound wave. Further, response characteristic for jetting the liquid-drops is superior, and the apparatus has a simple construction and the apparatus of a small size can be manufactured.

In the liquid jetting apparatus according to the invention, the liquid-drops are generated in the vicinity of the edge of the jetting spout. Accordingly, number of the edges is increased by providing a plurality of jetting spouts, and a lot of liquid-drops can be jetted. This facilitates high-speed and high-density printing and development.

Furthermore, in the liquid jetting apparatus of the invention, it is possible to decrease amplitude of the sound wave required for jetting the same amount of the liquid and make the construction simple and small. Particularly when the jetting spouts are arranged in plural trains, the space required for the arrangement is saved.

In the electrostatic latent image developing apparatus of the invention, it is possible to generate a lot of liquid-drops of small and uniform particle size and perform a high-speed and high-density developing without scumming, fog, and unevenness.

In the electrostatic latent image developing apparatus of the invention, the liquid-drops of large particle size among the jetted liquid-drops have a big inertia force in the early stage of the jetting, and are not easily attracted to the electrostatic latent image 81. Moreover, the liquid-drops are jetted deviating from the direction to the latent image carrier, and the ratio of the large liquid-drops contributing to development is decreased. As a result, it is possible to prevent the liquid-drops of large size, which are generated additionally when the jetting amount of the liquid-drops of small size is increased, from contributing to the development, and conduct a high-speed and high-density development without scumming and fog.

In the electrostatic latent image developing apparatus of the invention, when the liquid to be jetted is conductive, any grid as a member for applying it on the electrostatic latent image becomes unnecessary, and accordingly cleaning thereof becomes unnecessary.

In the electrostatic latent image developing apparatus of the invention, the pair of liquid-drop flows jetted from the pair of liquid jetting apparatus cross each other before reaching the latent image carrier. Thus, the liquid-drops of small size largely change their ways and are blown to the latent image carrier. On the other hand, the liquid-drops of large size have a large inertia force, and therefore they travel approximately straight without largely changing their ways, and do not reach the latent image carrier. As a result, it is possible to increase the advantages of the electrostatic latent image developing apparatus. Especially when the liquid-drops are charged, they repel and do not attach to each other.

Further, in the electrostatic latent image developing apparatus of the invention, ink is supplied only to the electrostatic latent image in the region where ink should be applied, and therefore it is possible to avoid wasteful supply of ink and increase economic efficiency.

Furthermore, in the electrostatic latent image developing apparatus of the invention, it is possible to establish any density according to picture, or further obtain a picture of many gradations by establishing the density for each of plural pictures wherein required density is different and by printing them on a recording paper repeatedly for each picture.

What is claimed is:

1. A liquid jetting apparatus including:

a container for storing liquid and having a jetting spout for jetting the liquid; and a sound wave generation source arranged opposite to the jetting spout on said container for introducing a sound wave producing a surface traveling wave, having a wavelength, on a surface of the liquid, in which a set of n (≧2) pulses having a cycle forms a burst and two such bursts adjacent to each other are separated by a period having no pulses and lasting for at least one of the cycles, wherein said jetting spout has an opening width of not less than 2m (m is a maximum value of n with respect to all of the bursts of pulses) times the wavelength of the surface traveling wave of the liquid excited by the sound wave.

2. The liquid jetting apparatus of claim 1, wherein the apparatus further includes a sound wave converging mechanism for converging the sound wave into said jetting spout.

3. The liquid jetting apparatus of claim 1, including a plurality of said jetting spouts arranged along a plurality of lines within a range where the sound wave propagates.

4. The liquid jetting apparatus of claim 3, wherein the apparatus further includes a sound wave convergence mechanism for converging the sound wave into said jetting spouts.

5. An electrostatic latent image developing apparatus including:

a container for storing liquid and having a jetting spout for jetting the liquid;

a sound wave generation source arranged opposite to the jetting spout on said container for introducing a sound wave producing a surface traveling wave, having a wavelength, on a surface of the liquid, in which a set of n (≧2) pulses having a cycle forms a burst and two such bursts adjacent to each other are separated by a period having no pulses and lasting for at least one of the cycles; and a latent image carrier where an electrostatic latent image is produced and which moves, wherein said jetting spout has an opening width of not less than 2m (m is a maximum value of n with respect to all of the bursts of pulses) times the wavelength of the surface traveling wave of the liquid excited by the sound wave, and develops the electrostatic latent image by selectively applying the liquid to the electrostatic latent image.

6. The electrostatic latent image developing apparatus of claim 5, wherein said jetting spout jets the liquid in a direction deviating from a direction perpendicular to said latent image carrier.

7. The electrostatic latent image developing apparatus of claim 6, including a pair of said jetting spouts arranged so that said jetting spouts are directed toward said latent image carrier at positions opposite to each other.

8. The electrostatic latent image developing apparatus of claim 6, wherein the apparatus further includes:

a capture plate facing said jetting spout; and a power source for applying a voltage to said jetting spout relative to said capture plate with a polarity opposite to that of the electrostatic latent image.

9. The electrostatic latent image developing apparatus of claim 8, including a pair of said jetting spouts arranged so that said jetting spouts are directed toward said latent image carrier at positions opposite to each other.

10. The electrostatic latent image developing apparatus of claim 5, wherein position of the electrostatic latent image in a moving direction of said latent image carrier is detected from a picture signal on which the electrostatic latent image is based, and timing of said jetting spout for jetting the liquid is controlled based on the position.

11. The electrostatic latent image developing apparatus of claim 5, wherein:

said jetting spout is divided into a plurality of blocks which can be driven independently; and position of the electrostatic latent image in a direction transverse to a moving direction of said latent image carrier is detected from a picture signal on which the electrostatic latent image is based, and timing of said jetting spout for jetting the liquid is controlled in each of the blocks based on the position.

12. The electrostatic latent image developing apparatus of claim 5, wherein the apparatus further includes a sound wave convergence mechanism for converging the sound wave into said jetting spout.

13. The electrostatic latent image developing apparatus of claim 5, including a plurality of said jetting spouts arranged along a plurality of lines within a range where the sound wave propagates.

14. The liquid jetting apparatus of claim 13, wherein the apparatus further includes a sound wave convergence mechanism for converging the sound wave into said jetting spouts.

15. An electrostatic latent image developing apparatus including:

a latent image carrier where an electrostatic latent image is produced and which moves;

a container for storing liquid and having a jetting spout for jetting the liquid;

a sound wave generation source arranged opposite to the jetting spout on said container for introducing a sound wave producing a traveling wave, having a wavelength, on a surface of the liquid, in which a set of n (≧2) pulses having a cycle forms a burst and two such bursts adjacent to each other are separated by a period having no pulses and lasting for at least one of the cycles; and a liquid jetting apparatus for developing the electrostatic latent image by selectively applying the liquid onto the electrostatic latent image, wherein density of the electrostatic latent image is detected from a picture signal on which the electrostatic latent image is based, and the liquid jetted by said liquid jetting apparatus in a unit time is controlled based on the density.

* * * * *